US010148055B2

(12) United States Patent
Hirata et al.

(10) Patent No.: US 10,148,055 B2
(45) Date of Patent: Dec. 4, 2018

(54) WIRE HARNESS PRODUCTION METHOD

(71) Applicant: YAZAKI CORPORATION, Tokyo (JP)

(72) Inventors: Akiyuki Hirata, Makinohara (JP); Koichi Nakahara, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 205 days.

(21) Appl. No.: 15/134,522

(22) Filed: Apr. 21, 2016

(65) Prior Publication Data

US 2016/0233638 A1 Aug. 11, 2016

Related U.S. Application Data

(63) Continuation of application No. PCT/JP2014/079570, filed on Nov. 7, 2014.

(30) Foreign Application Priority Data

Nov. 12, 2013 (JP) ..... 2013-233610

(51) Int. Cl.
*H01R 43/00* (2006.01)
*H01R 43/28* (2006.01)
*H01R 43/048* (2006.01)

(52) U.S. Cl.
CPC ..... *H01R 43/28* (2013.01); *H01R 43/048* (2013.01); *Y10T 29/49174* (2015.01)

(58) Field of Classification Search
CPC .. B60R 16/0207; H01R 43/048; H01R 43/28; Y10T 29/49117; Y10T 239/49174;
(Continued)

(56) References Cited

U.S. PATENT DOCUMENTS 5,208,977 A * 5/1993 Ricard ..... G02B 6/3833 29/33 F
7,718,217 B2 * 5/2010 Kamata ..... H01B 13/345 427/117
2005/0060881 A1 3/2005 Kamata et al.

FOREIGN PATENT DOCUMENTS

CN 1610957 A 4/2005
CN 1813319 B 9/2011
(Continued)

OTHER PUBLICATIONS

Communication dated Oct. 19, 2016, from the State Intellectual Property Office of People's Republic of China in counterpart Application No. 201480058618.1.
(Continued)

*Primary Examiner* — Thiem Phan
(74) *Attorney, Agent, or Firm* — Sughrue Mion, PLLC

(57) ABSTRACT

A wire harness production system includes an electric wire sequential production portion that sequentially manufactures terminal-fitted electric wires from an electric wire, and a temporarily-storing and handling portion that temporarily stores the terminal-fitted electric wires before supplying them to a post process. The electric wire sequential production portion includes a coloring unit that colors a sheath of the electric wire or sheaths of the terminal-fitted electric wires by a colorant, and a cutting and crimping unit that manufactures the terminal-fitted electric wires by cutting the electric wire to a predetermined length and fitting a metal terminal at an end of the cut electric wire. The temporarily-storing and handling portion includes plural temporarily-storing portions that temporarily store the terminal-fitted electric wires in a production order before supplying them to the post process.

7 Claims, 5 Drawing Sheets

(58) Field of Classification Search
CPC ..... Y10T 29/49194; Y10T 29/49826; H01B 13/34; H01B 13/012
USPC ..... 29/857, 825, 854, 868, 874
See application file for complete search history.

(56) References Cited

FOREIGN PATENT DOCUMENTS

| | | | |
|---|---|---|---|
| EP | 1630826 | A2 | 3/2006 |
| JP | 7-001645 | B2 | 1/1995 |
| JP | 2001-332144 | A | 11/2001 |

OTHER PUBLICATIONS

Communication dated Apr. 19, 2017, from the State Intellectual Property Office of the P.R.C., in counterpart Chinese application No. 201480058618.1.
International Search Report for PCT/JP2014/079570 dated Jan. 20, 2015.

* cited by examiner

WIRE HARNESS PRODUCTION METHOD

CROSS-REFERENCE TO RELATED APPLICATIONS

The present application is a Continuation Application of PCT International Application No. PCT/JP2014/079570 (filed on Nov. 7, 2014), which is based upon and claims the benefit of priority from Japanese Patent Application No. 2013-233610 (filed on Nov. 12, 2013), the entire contents of which are incorporated herein with reference.

BACKGROUND OF INVENTION

Technical Field

The present invention relates to a wire harness production system and a wire harness production method for producing a terminal-fitted electric wire and inserting a metal terminal of the terminal-fitted electric wire into a connector housing.

Background Art

In an automobile (moving vehicle), an enormous number of electric wires are used. Such an enormous number of electric wires constitute wire harnesses. Various electric devices for establishing fundamental performances (i.e. performances of drive, turn and stop), safety, usability and comfortability are installed on an automobile. These various electric devices are operated by electric power from a battery and control signals, and the electric power and the control signals are transmitted by wire harnesses. Various kinds (length, diameter and insulator material) of wires are needed for wire harnesses according to kinds of devices, electric current values, routing positions and so on.

Productions of wire harnesses constituted of various kinds of electric wires become very hard, if appearances of all electrical wires are identical to each other. In addition, erroneous connections may occur when connecting devices with each other. Further, it may pose problems for doing maintaining them. Therefore, in order to discriminate various kinds of electric wires, coloring or markings are generally made on their sheaths (see a Patent Literature 1 listed below).

A prior-art wire harness production system includes a sub-harness production line for manufacturing intermediate products such as sub-harnesses, and a wire harness assembly line for assembling wire harnesses from the sub-harnesses, outer components and so on. Hereinafter, configuration and a production method of the sub-harness production line will be described with reference to FIG. 5.

As shown in FIG. 5, an electric wire reel 101 is comprised of a reel and an electric wire wound around the reel. For example, a 0.5 sq electric wire (it may be 0.3 sq, 0.8 sq or the like) is wound. One electric wire drawn out from the electric wire reel 101 is supplied to a coloring unit 102 (the electric wire reel 101 is configured so as to supply the electric wire). A sheath of the electric wire supplied from the electric wire reel 101 is colored at the coloring unit 102. The electric wire whose sheath is colored is supplied to a cutting and crimping unit 103.

The cutting and crimping unit 103 is comprised of a measuring and cutting device 104, an A-end crimping device 105 and a B-end crimping device 106. In the measuring and cutting device 104, a length of the electric wire is measured, and then cut to a predetermined length based on the measured value. The cut electric wire is called as a measured-and-cut electric wire.

In the A-end crimping device 105, a metal terminal is fitted (crimped) to an A-end (a leading end in its moving direction) of the electric wire. Subsequently, in the B-end crimping device 106, a metal terminal is similarly fitted (crimped) to a B-end (an opposite side to the A-end: a trailing end in the moving direction) of the electric wire. The metal terminals are supplied from terminal reels 107 and 108. By fitting the metal terminals to the A-end and the B-end, respectively, a terminal-fitted electric wire 109 is completed. Note that this production line 111 is comprised of processes done by automated machines.

The metal terminal of the terminal-fitted electric wire(s) 109 is inserted into a cavity of a connector housing (a terminal insertion process 110). In the terminal insertion process 110, the metal terminals of the terminal-fitted electric wires 109 as many as required for a sub-harness are inserted into the cavities. Namely, the terminal-fitted electric wires 109 are sequentially supplied from the preceding process, and the metal terminals are inserted sequentially. The metal terminals are inserted manually. When the insertions of the metal terminals as many as required are completed, one sub-harness is completed. This production line 112 is a process done by an operator(s) manually.

In the wire harness assembly line, the sub-harnesses manufactured in the above-described sub-harness production line are assembled on a wiring board and then bundled by a tape, and an outer component(s) is attached thereto.

CITATION LIST

Patent Literature

Patent Literature 1: Japanese Examined Application Publication No. H7-1645

SUMMARY OF INVENTION

In the above-described production of a sub-harness, there is a difference of process speeds (production capacities) between the production line 111 with automated machines and the line 112 with hand works, and thereby synchronized continuous productions are difficult. For example, if the production line 111 with automated machines delays in a set-up change and so on for a process for crimping metal terminals or prior processes thereto, an Operator have to wait in the terminal insertion process 110. In addition, speeds for a process for crimping metal terminals or prior processes thereto has to be decreased in a case where the insertion process of metal terminals delays, but operation rates of the automated machines reduce.

Therefore, an object of the present invention is to provide a wire harness production system and a wire harness production method by which continuous productions can be done smoothly by settling a difference of production capacities on its production line.

A first aspect of the present invention provides a wire harness production system by which terminal-fitted electric wires required for a production of a wire harness are sequentially manufactured and then a post process is done by using the manufactured terminal-fitted electric wires, the system comprising: an electric wire sequential production portion that sequentially manufactures the terminal-fitted electric wires from an electric wire; and a temporarily-storing and handling portion that temporarily stores the terminal-fitted electric wires manufactured by the electric wire sequential production portion before supplying to the post process, wherein the electric wire sequential production portion includes a coloring unit that colors a sheath of the electric wire or sheaths of the terminal-fitted electric wires by a colorant, and a cutting and crimping unit that manufactures the terminal-fitted electric wires by cutting the electric wire to a predetermined length and fitting a metal terminal at an end of the cut electric wire, and the temporarily-storing and handling portion includes a plurality of temporarily-storing portions that temporarily store the terminal-fitted electric wires manufactured by the electric wire sequential production portion in a production order before supplying to the post process.

According to the first aspect, continuous production can be done smoothly by absorbing, by the temporarily-storing and handling portion, a difference of production capacities between the electric wire sequential production portion and the post process. In addition, operator's waiting and reduction of the system operation rates can be also prevented by providing the temporarily-storing and handling portion.

Here, it is preferable that the post process is done by a terminal insertion portion that inserts the metal terminals of the terminal-fitted electric wires into a connector housing.

According to this, it becomes possible to effectively absorb, by the temporarily-storing and handling portion, a difference between production capacity of the electric wire sequential production portion that is generally with automated machines and production capacities of the terminal insertion portion that is generally with hand works.

Further, it is preferable that the temporarily-storing and handling portion has the temporarily-storing portions for the terminal-fitted electric wires at least equal-to or more-than the number of the terminal-fitted electric wires required for a production of one sub-harness.

According to this, it becomes possible to temporarily store the terminal-fitted electric wires as many as required for one sub-harness at the temporarily-storing and handling portion. Since the terminal-fitted electric wires are temporarily stored in a production order and they are as many as required for one sub-harness, it becomes possible that the terminal insertions that will be done later aren't done in the production order. Namely, it becomes possible to change an insertion order of the metal terminals according to the connector housing, and thereby working flexibility can be improved.

A second aspect of the present invention provides a wire harness production method for sequentially manufacturing terminal-fitted electric wires required for a production of a wire harness and then carrying out a post process by using the manufactured terminal-fitted electric wires, the method comprising: an electric wire sequential production process for sequentially manufacturing the terminal-fitted electric wires from an electric wire; and a temporarily-storing and handling process for temporarily storing the terminal-fitted electric wires manufactured in the electric wire sequential production process before supplying to the post process, wherein the electric wire sequential production process includes a process for coloring a sheath of the electric wire or sheaths of the terminal-fitted electric wires by a colorant, and a process for manufacturing the terminal-fitted electric wires by cutting the electric wire to a predetermined length and fitting a metal terminal at an end of the cut electric wire, and the temporarily-storing and handling process includes a process for temporarily storing the terminal-fitted electric wires manufactured in the electric wire sequential production process at a plurality of temporarily-storing portions in a production order before supplying to the post process.

According to the second aspect, continuous production can be done smoothly by absorbing, by the temporarily-storing and handling process, a difference of production capacities between the electric wire sequential production process and the post process. In addition, operator's waiting and reduction of the system operation rates can be also prevented by providing the temporarily-storing and handling process.

Here, it is preferable that the post process is a terminal insertion process for inserting the metal terminals of the terminal-fitted electric wires into a connector housing.

According to this, it becomes possible to effectively absorb, by the temporarily-storing and handling process, a difference between production capacity of the electric wire sequential production process that is generally done by automated machines and production capacities of the terminal insertion process that is generally done by hand works.

DESCRIPTION OF EMBODIMENTS

A wire harness production system (a wire harness production method) according to an embodiment will be explained with reference to the diagrams.

Figure 1:
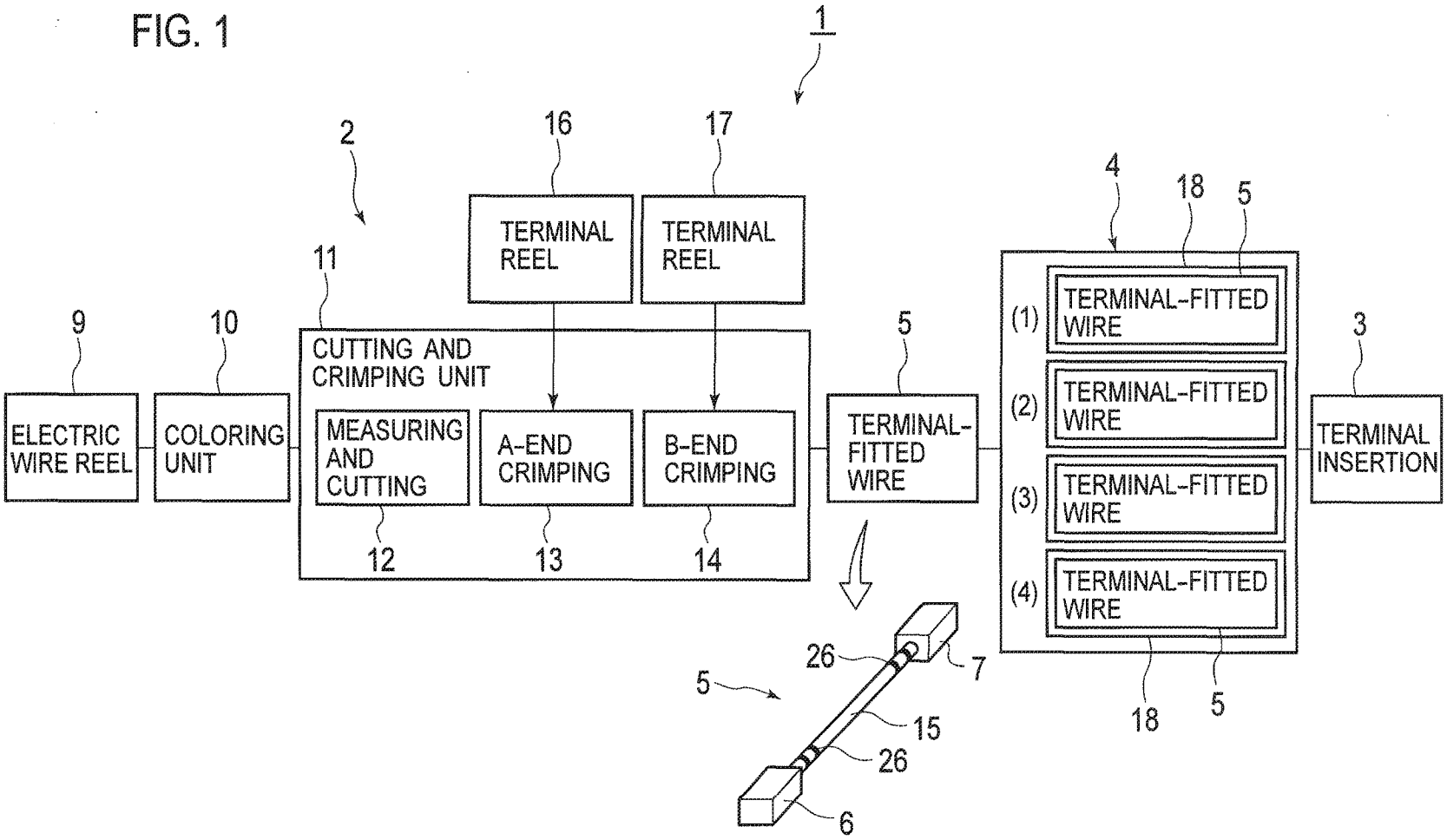
FIG. 1 is a configuration diagram (a process chart) of a sub-harness production line in a wire harness production system (a wire harness production method) according to an embodiment.

As shown in FIG. 1, the wire harness production system according to the present embodiment includes a sub-harness production line 1 for manufacturing intermediate products such as sub-harnesses, and a wire harness assembly line for assembling wire harnesses from the sub-harnesses, outer components and so on. Since the sub-harness production line 1 has features in the present embodiment, configuration and processes of the sub-harness production line 1 will be described in detail hereinafter.

The sub-harness production line 1 is constituted to include an electric wire sequential production portion (process) 2, a terminal insertion portion (process) 3, and a temporarily-storing and handling portion (process) 4 disposed between the electric wire sequential production portion 2 and the terminal insertion portion 3.

In the electric wire sequential production portion 2, a process for automatically manufacturing terminal-fitted electric wires 5 that are required for productions of wire harnesses sequentially (the electric wire sequential production process) is done. In the temporarily-storing and handling portion 4, a process for temporarily storing the terminal-fitted electric wires 5 (the temporarily-storing and handling process) is done. In the terminal insertion portion 3, a process for inserting metal terminals 6 and 7 that constitute a terminal-fitted electric wire 5 into a connector housing 8 (see FIG. 2) (the terminal insertion process) is done. Note that the terminal insertion process done in the terminal insertion portion 3 is a post process that is done by using the terminal-fitted electric wires 5 manufactured in the electric wire sequential production portion (process) 2.

The electric wire sequential production portion (process) 2 is controlled by a computer (not shown in the drawings), and operated by a control mechanism (not shown in the drawings). Its controller by the computer is configured to be able to integrally control all components of the electric wire sequential production portion 2 (it may be controlled with respect to each component). The controller is configured to have a CPU, a RAM, a ROM and so on that are commonly known.

The electric wire sequential production portion 2 includes an electric wire reel 9, a coloring unit 10, and a cutting and crimping unit 11. Note that the three units 9 to 11 will be described here, but the number of units in the electric wire sequential production portion 2 is not limited as long as the electric wire sequential production portion 2 is constituted of sequential automated machines.

The electric wire reel 9 has a cylindrical reel main body, and a pair of flanges on both ends of the reel main body. A 0.5 sq electric wire (it may be 0.3 sq, 0.8 sq or the like) is wound around the reel main body.

An electric wire is comprised of a conductor and a sheath (an insulator). The conductor has electrical conductive property. On the other hand, the sheath has insulation property. The sheath is formed by extruding melted plastic on an outer surface of the conductor. White colorants are contained in the plastic of the sheath, so that the sheath has a white color. Or, the sheath may have a natural color without adding any colorants. Note that the sheath has a white color in the present embodiment, but it may have a natural color or other colors.

The electric wire reel 9 has a reel support portion that supports the reel main body rotatably, an electric wire guide portion that guides an electric wire drawn out from the electric wire reel 9 to the coloring unit 10, and a drawing mechanism (a drive mechanism) that draws an electric wire out from the electric wire reel 9. One electric wire drawn out from the electric wire reel 9 is supplied to the coloring unit 10 via the electric wire guide portion. Note that the drawing mechanism may be provided at the coloring unit 10, or may be provided at a portion of a post process after the coloring unit 10.

The coloring unit 10 is configured to make a predetermined coloring on the sheath of the electric wire supplied from the electric wire reel 9. In addition to making a color band along a circumferential direction of the sheath, a colored dot(s) or a colored marking(s) may be made (marked). In addition, an entire of the sheath may be colored. Namely, the coloring unit 10 may be called as a "coloring or marking unit". Note that, in the present embodiment, an example for adding a color band (see, after-mentioned colored portions 26) in a circumferential direction of the sheath by the coloring unit 10 will be described.

Here, "coloring" will be explained. "Coloring" is adding a color on an outer surface of the sheath by a colorant. A colorant is a liquid material in which a coloring material (an industrial organic material) is dissolved or dispersed into water or other solvents. There are dyes and pigments as an organic material (most of them are an organic matter, and a composition), sometimes, dyes are used as pigments, or pigments are used as dyes. More specifically, a colorant is coloring liquid or paint.

Coloring liquid is made by dissolving or dispersing dye(s) into a solvent. Paint is made by dispersing a pigment(s) into dispersion liquid. Therefore, by coloring on an outer surface of the sheath by coloring liquid, dye(s) infiltrates into the sheath. By coloring on an outer surface of the sheath by paint, pigment(s) adheres on the outer surface without infiltrating into the sheath. Namely, "coloring" used here is to dye an outer surface of the sheath by dye(s), or to paint pigment(s) on an outer surface of the sheath.

As an above-mentioned solvent or dispersion liquid, one having avidity with the plastic that forms the sheath is preferred. In this case, dye(s) infiltrates into the sheath sufficiently, and pigment(s) adheres on an outer surface of the sheath firmly.

The cutting and crimping unit 11 is comprised of plural machines, specifically, comprised of a measuring and cutting machine 12, an A-end side crimping machine 13, and a B-end side crimping machine 14.

The measuring and cutting machine 12 measures a length of an electric wire colored by the coloring unit 10, and then cuts the electric wire to a predetermined length based on the measured value. Specifically, it includes a measuring portion that measures a length of an electric wire, and an electric wire cutting portion that cuts the electric wire to a predetermined length based on the measurement of the measuring portion. The electric wire cut to the predetermined length based on the measurement of the measuring portion is called as a measured-and-cut electric wire 15.

The A-end side crimping machine 13 crimps a metal terminal 6 at an A-end (a leading end in a moving direction) of an electric wire before or after cutting the electric wire to the above-mentioned predetermined length (note that it is not limited to crimping, for example, the metal terminal may be press-fitted or welded, in this case, "crimping" is regarded as "press-fitting" or "welding"). Specifically, the A-end side crimping machine 13 is comprised of a sheath removing portion that removes the sheath at the A-end of the electric wire to expose the conductor, and a terminal fitting portion that fits the metal terminal 6 to the conductor exposed by the sheath removing portion. The metal terminal 6 is supplied from a terminal reel 16.

The B-end side crimping machine 14 crimps a metal terminal 7 at a B-end (an opposite side to the A-end: a trailing end in the moving direction) of an electric wire after cutting away the measured-and-cut electric wire 15 (note that it is not limited to crimping). Specifically, the B-end side crimping machine 14 is comprised of a sheath removing portion that removes the sheath at the B-end of the electric wire to expose the conductor, and a terminal fitting portion that fits the metal terminal 7 to the conductor exposed by the sheath removing portion. The metal terminal 7 is supplied from a terminal reel 17.

When the metal terminals 6 and 7 are fitted to the A-end and the B-end, respectively, one terminal-fitted electric wire 5 is completed. The terminal-fitted electric wires 5 are sequentially manufactured by the electric wire sequential production portion 2 automatically.

The terminal-fitted electric wire 5 is composed of the measured-and-cut electric wire 15, and the metal terminals 6 and 7 that are fitted to its both ends, respectively. Colored portions 26 colored by the coloring unit 10 are formed at both ends of the terminal-fitted electric wire 5, respectively. The colored portion(s) 26 is a color band formed in a circumferential direction.

The temporarily-storing and handling portion 4 includes temporarily-storing portions 18. The terminal-fitted electric wires 5 manufactured by the electric wire sequential production portion 2 are temporarily stored at the temporarily-storing portions 18 before being supplied to the terminal insertion portion 3.

The terminal-fitted electric wires 5 are stored at the temporarily-storing portions 18 in an order of productions at the electric wire sequential production portion 2. Four of the terminal-fitted electric wires 5 are stored at the temporarily-storing and handling portion 4 shown in FIG. 1. Note that the number of storages here is not limited, the temporarily-storing portions 18 as many as the number of the terminal-fitted electric wires 5 required for a production of one sub-harness is provided in the temporarily-storing and handling portion 4. Or, the temporarily-storing portions 18 as many as the number of the terminal-fitted electric wires 5 required for productions of plural sub-harnesses may be provided in the temporarily-storing and handling portion 4. If the terminal-fitted electric wires 5 are stored in an order of productions of sub-harnesses, the terminal-fitted electric wires 5 can be easily handled.

Figure 2A:
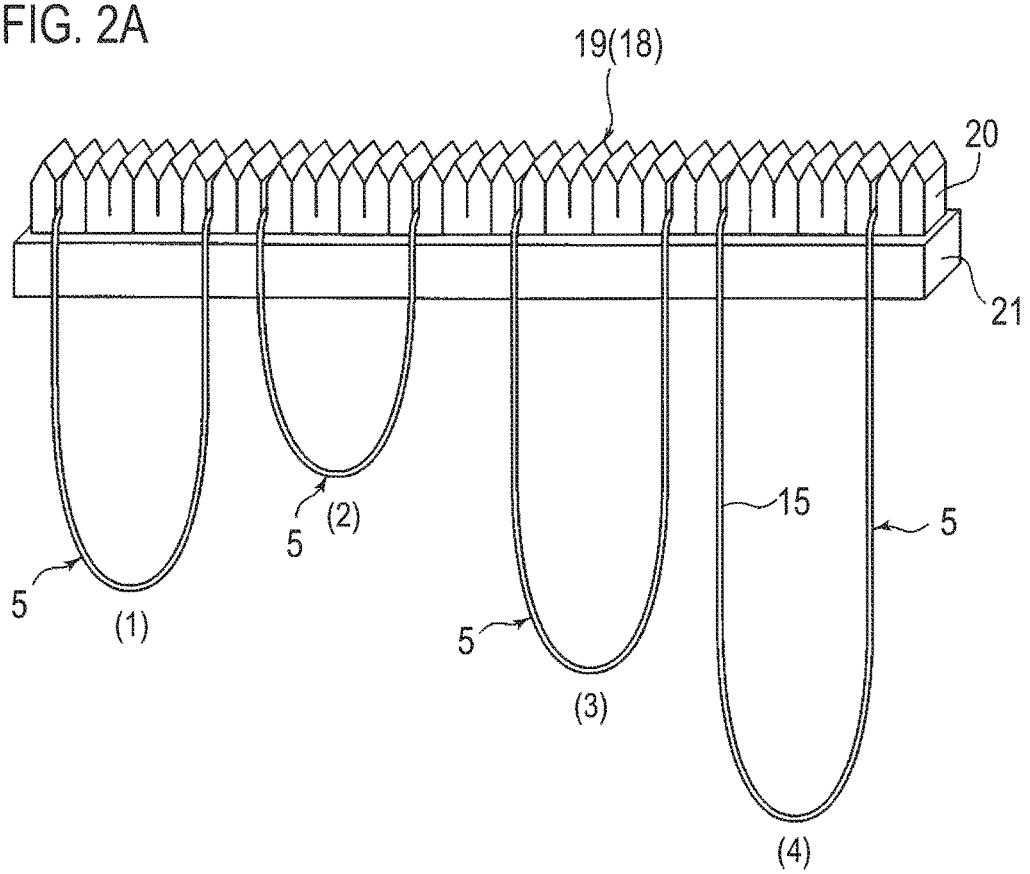
FIG. 2A is a perspective view showing an example of a temporarily-storing and handling portion.
Figure 2B:
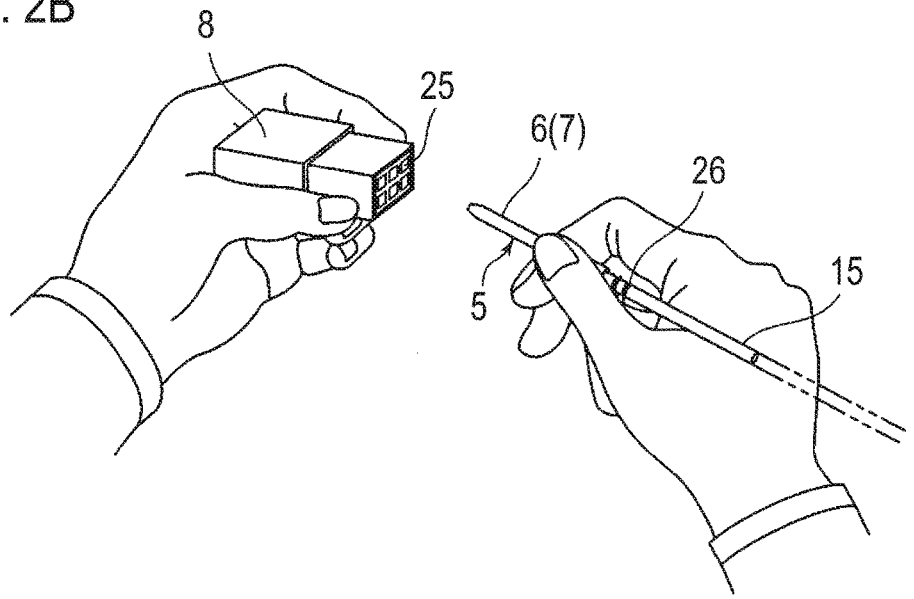
FIG. 2B is a perspective view showing an example of an operation at a terminal insertion portion.

The temporarily-storing portion(s) 18 shown in FIG. 2A is constituted of a commonly known electric wire storing rod 19. The electric wire storing rod 19 is comprised of many electric wire clips 20 aligned its longitudinal direction, and a clip base 21 that holds the electric wire clips 20. Each of the electric wire clips 20 is constituted of a pair of pinching elements, and an electric wire storing portion for pinching the measured-and-cut electric wire 15 of the terminal-fitted electric wire 5 is formed between the pair of pinching elements. Tapered portions for guiding an electric wire are formed at each distal end of the pinching elements. The tapered portion(s) is inclined toward the electric wire storing portion. All the electric wire clips 20 have an identical size and an identical shape to each other. Dozens of the electric wire clips 20 are formed on the single electric wire storing rod 19. Note that numbers (1) to (4) shown in FIG. 1 and FIG. 2 indicate a production order at the electric wire sequential production portion 2.

Figure 3:
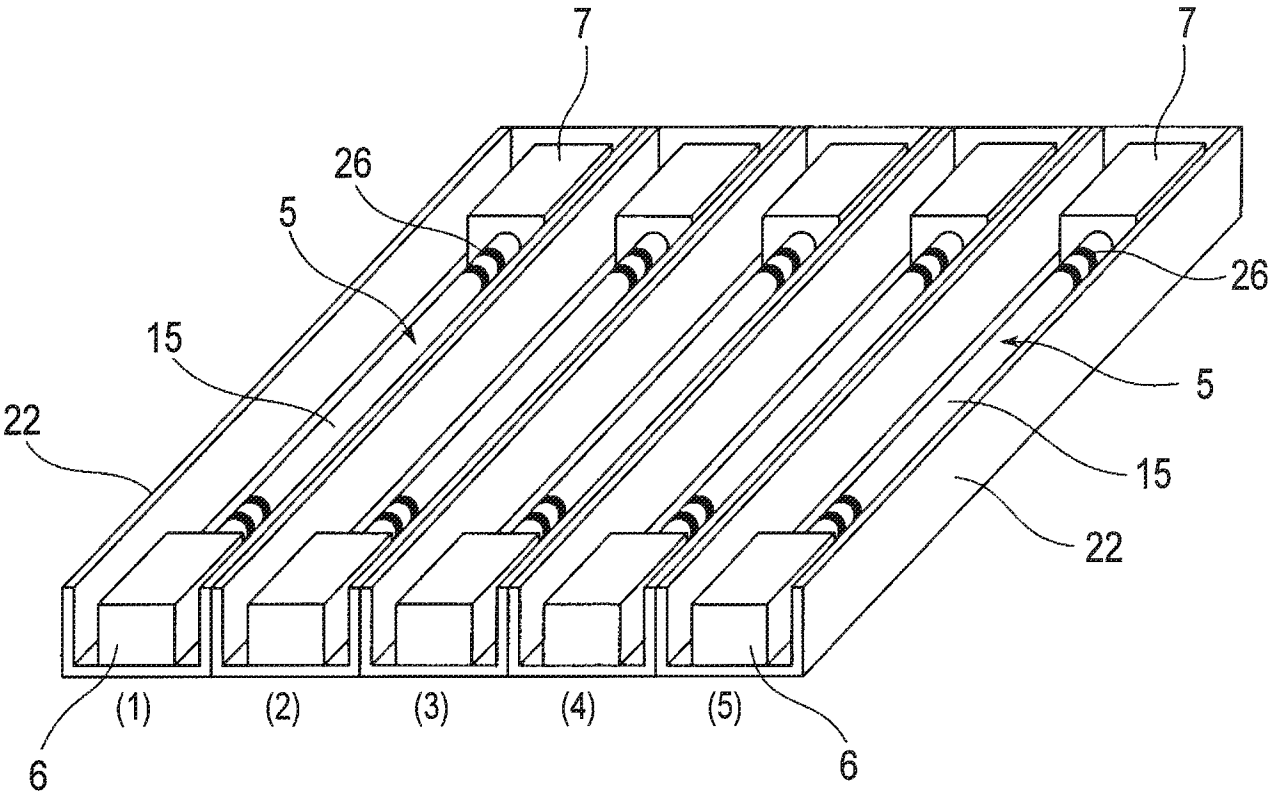
FIG. 3 is a perspective view showing another example of the temporarily-storing and handling portion.
Figure 4:
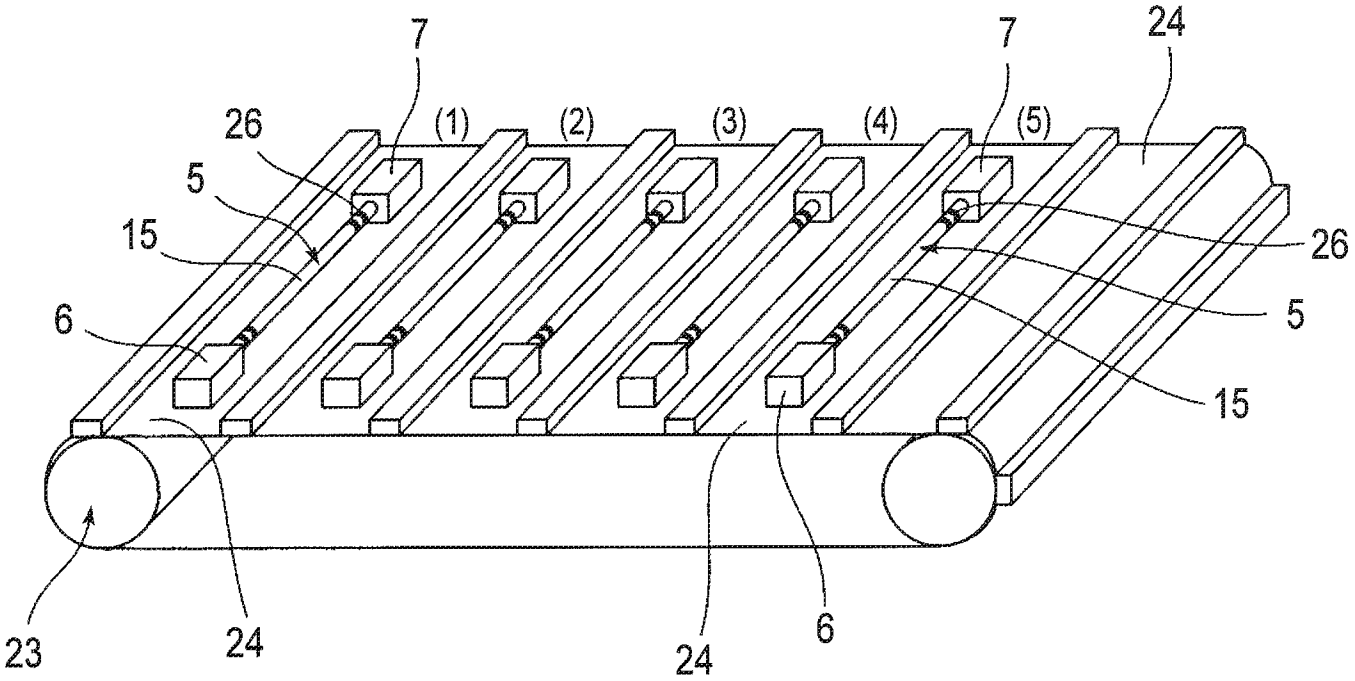
FIG. 4 is a perspective view showing yet another example of the temporarily-storing and handling portion.
Figure 5:
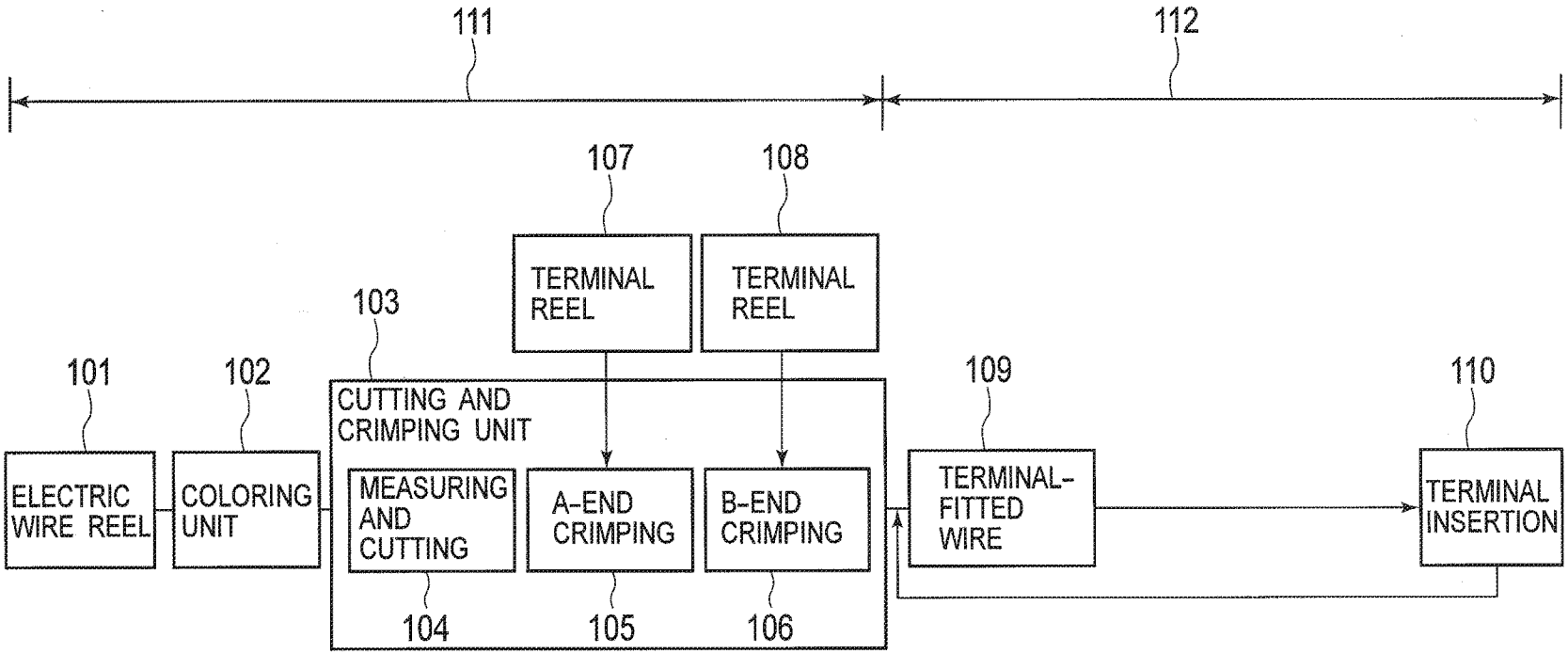
FIG. 5 is a configuration diagram (a process chart) of a prior-art sub-harness production line.

Another example of the temporarily-storing portion is shown in FIG. 3. The temporarily-storing portion 22 shown in FIG. 3 is formed as five gutters. In addition, yet another example of the temporarily-storing portion is shown in FIG. 4. The temporarily-storing portion 24 shown in FIG. 4 is provided on a conveyor 23. Note that numbers (1) to (5) shown in FIG. 3 and FIG. 4 indicate a production order at the electric wire sequential production portion 2.

As shown in FIG. 1 and FIG. 2A, the metal terminal 6 or 7 of the terminal-fitted electric wire 5 is inserted into a cavity 25 of the connector housing 8 at the terminal insertion portion 3. Specifically, the terminal insertion portion 3 is comprised of a supply portion of the connector housing 8, a work table, and so on. Note that the connector housing 8 is held by a hand in an example shown in FIG. 2B, but the connector housing 8 may be held by a specially-prepared jig.

Insertions of the metal terminals 6 (7) are done with respect to the terminal-fitted electric wires 5 as many as required for a production of a sub-harness. Namely, the terminal-fitted electric wires 5 are sequentially picked up from the temporarily-storing portions 18, and the metal terminals 6 (7) are sequentially inserted into the cavities 25 of the connector housing 8. The metal terminals 6 (7) are inserted manually. When insertions of the metal terminals 6 (7) as many as required are completed, one sub-harness is completed.

Note that a sub-harness means a state where all the metal terminals 6 (7) of the terminal-fitted electric wires 5 as many as required are inserted into the connector housing 8, and a state of being jointed. In other words, in a sub-harness, there is no metal terminal 6 (7) that remains exposed.

The terminal insertion process is not affected by a production condition in the electric wire sequential production process. The reason is that the temporarily-storing and handling process is provided as a directly preceding process. Specifically, the reason is that the terminal-fitted electric wires 5 required for the terminal insertion process are temporarily stored at the temporarily-storing portions 18 of the temporarily-storing and handling portion 4

As described above, sub-harnesses are continuously manufactured by the sub-harness production line 1 according to the wire harness production system (method). In this continuous production, since the sub-harness production line 1 includes the temporarily-storing and handling portion (process) 4, a difference of production capacities between the electric wire sequential production portion (process) 2 with automated machines and the terminal insertion portion (process) 3 with hand works can be absorbed. Therefore, the continuous production can be done smoothly.

In addition, since the temporarily-storing and handling portion (process) 4 is provided between the electric wire sequential production portion (process) 2 and the terminal insertion portion (process) 3, operator's waiting and reduction of the system operation rates can be also prevented.

If the terminal insertions done manually (by hand works) delay, adjustments can be made by providing the terminal insertion portion (process) 3 in a plurality. Since the terminal-fitted electric wires 5 are laid on the temporarily-storing portions 18 in their production order, adaptation can be easily done achieved even if the plural terminal insertion portions (processes) 3 are provided.

Further, if set-up changes occur frequently, operator's waiting at the terminal insertion portion (process) 3 can be prevented by preliminarily storing the terminal-fitted electric wires 5 required for plural sub-harnesses.

What is claimed is:

1. A wire harness production method for sequentially manufacturing terminal-fitted electric wires required for a production of a wire harness and then carrying out a post process by using the manufactured terminal-fitted electric wires, the method comprising:

an electric wire sequential production process for sequentially manufacturing the terminal-fitted electric wires from an electric wire before supplying the terminal-fitted electric wires to a plurality of temporarily-storing portions; and a temporarily-storing and handling process for temporarily storing the terminal-fitted electric wires manufactured in the electric wire sequential production process before supplying to the post process, wherein the electric wire sequential production process includes a process for coloring a sheath of the electric wire or sheaths of the terminal-fitted electric wires by a colorant, and a process for manufacturing the terminal-fitted electric wires by cutting the electric wire to a predetermined length and fitting a metal terminal at an end of the cut electric wire, and the temporarily-storing and handling process includes a process for temporarily storing the terminal-fitted electric wires manufactured in the electric wire sequential production process at the plurality of temporarily-storing portions in a production order before supplying to the post process.

2. The wire harness production method according to claim 1, wherein the post process is a terminal insertion process for inserting the metal terminals of the terminal-fitted electric wires into a connector housing.

3. The wire harness production method according to claim 1, wherein the electric wire sequential production process comprises:

drawing the electric wire out from an electric wire reel;

coloring the sheath of the electric wire or sheaths of the terminal-fitted electric wires by the colorant based on drawing the electric wire out from the electric wire reel; and supplying the electric wire to a cutting and crimping machine after coloring the sheath of the electric wire or sheaths of the terminal-fitted electric wires by the colorant, and wherein the temporarily-storing and handling process for temporarily storing the terminal-fitted electric wires is performed after supplying the electric wire to the cutting and crimping machine.

4. The wire harness production method according to claim 1, wherein the electric wire sequential production process comprises:

measuring a length of the electric wire after the electric wire is colored according to the coloring process;

cutting the electric wire to the predetermined length based on measuring the length of the electric wire;

crimping the metal terminal at the end of the cut electric wire after cutting the electric wire to the predetermined length; and crimping another metal terminal at another end of the cut electric wire based on crimping the metal terminal at the end of the cut electric wire, and wherein the temporarily-storing and handling process for temporarily storing the terminal-fitted electric wires is performed after crimping the other metal terminal at the other end of the cut electric wire.

5. The wire harness production method according to claim 1, wherein the temporarily-storing and handling process for temporarily storing the terminal-fitted electric wires comprises:

supplying the electric wire to an electric wire storing rod after cutting the electric wire to the predetermined length and fitting the metal terminal at the end of the cut electric wire, wherein the electric wire storing rod includes the plurality of temporarily-storing portions.

6. The wire harness production method according to claim 1, wherein the temporarily-storing and handling process for temporarily storing the terminal-fitted electric wires comprises:

supplying the electric wire to a set of gutters after cutting the electric wire to the predetermined length and fitting the metal terminal at the end of the cut electric wire, wherein the set of gutters includes the plurality of temporarily-storing portions.

7. The wire harness production method according to claim 1, wherein the temporarily-storing and handling process for temporarily storing the terminal-fitted electric wires comprises:

supplying the electric wire to a conveyor after cutting the electric wire to the predetermined length and fitting the metal terminal at the end of the cut electric wire, wherein the conveyor includes the plurality of temporarily-storing portions.

* * * * *